US008562002B2

(12) United States Patent
Jenkins

(10) Patent No.: US 8,562,002 B2
(45) **Date of Patent: *Oct. 22, 2013**

(54) MODULAR MOBILE WORKSTATION WITH STORAGE CAPACITY

(76) Inventor: Jeff Jenkins, Alexandria, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/470,741

(22) Filed: May 14, 2012

(65) Prior Publication Data

US 2012/0292866 A1 Nov. 22, 2012

Related U.S. Application Data

(63) Continuation of application No. 12/929,443, filed on Jan. 25, 2011, now Pat. No. 8,196,938, which is a continuation of application No. 12/659,598, filed on Mar. 15, 2010, now Pat. No. 7,891,677, which is a continuation of application No. 12/071,444, filed on Feb. 21, 2008, now Pat. No. 7,708,290, which is a continuation of application No. 11/002,434, filed on Dec. 3, 2004, now Pat. No. 7,347,430.

(60) Provisional application No. 60/529,095, filed on Dec. 15, 2003.

(51) Int. Cl.
*B60N 2/28* (2006.01)

(52) U.S. Cl.
USPC ..... 280/30; 280/47.26; 280/47.34; 280/47.35

(58) Field of Classification Search
USPC ..... 280/47.26, 47.34, 47.35, 47.18, 47.23, 280/47.131, 87.05, 650, 640, 30
See application file for complete search history.

(56) References Cited

U.S. PATENT DOCUMENTS

| | | | |
|---|---|---|---|
| 609,696 | A | 8/1898 | Nicolle |
| 1,263,403 | A | 4/1918 | Gorton |
| 2,624,487 | A | 1/1953 | Fry |
| 2,738,561 | A | 3/1956 | Trilling et al. |
| 2,742,953 | A | 4/1956 | Kudrna |
| 2,827,004 | A | 3/1958 | Luce et al. |
| 2,912,785 | A | 11/1959 | Dewey |
| 2,919,017 | A | 12/1959 | Weber |
| 2,931,685 | A | 4/1960 | Harold |
| 3,036,145 | A | 5/1962 | Murphy |
| 3,236,538 | A | 2/1966 | Johansen |
| 3,286,872 | A | 11/1966 | Burdick, Jr. |
| 3,301,358 | A | 1/1967 | Ernest |
| 3,447,711 | A | 6/1969 | Bozek |
| 3,559,761 | A | 2/1971 | Wehner |
| 3,599,750 | A | 8/1971 | Serwer |

(Continued)

*Primary Examiner* — Hau Phan
(74) *Attorney, Agent, or Firm* — Nixon & Vanderhye PC

(57) ABSTRACT

The described embodiments provide a modular mobile workstation with storage capacity. The apparatus has a modular shell that can be used for a variety of purposes including, for example, a stool and low table combination, a table and coat-rack combination, and a high table combination. The modular shell encloses a removable inner shell that can be used to store goods while traveling with the unit. In one embodiment, two large wheels cap the respective ends of the shell and allow the apparatus to roll freely behind a user. A multi-use handle is also included with the apparatus. In one embodiment, the handle is collapsible and is secured to the apparatus by a securing scarf, which also serves to hold the interlocking pieces of the outer shell together. The unit is useful for travelers needing a mobile workspace, and prevents the need for additional luggage, as it also provides storage capacity.

20 Claims, 20 Drawing Sheets

(56) References Cited

U.S. PATENT DOCUMENTS

| | | | | |
|---|---|---|---|---|
| 3,856,166 | A | 12/1974 | Gibson | |
| 3,916,558 | A | 11/1975 | Crouch | |
| 4,160,495 | A | 7/1979 | Conard | |
| 4,583,661 | A | 4/1986 | Clover, Jr. | |
| 4,624,341 | A | 11/1986 | Lee | |
| 4,848,782 | A | 7/1989 | Schmidt | |
| 4,978,023 | A | 12/1990 | Behimann et al. | |
| 5,269,157 | A | 12/1993 | Ciminelli et al. | |
| 5,599,258 | A | 2/1997 | Stone et al. | |
| 5,636,738 | A | 6/1997 | Riedel | |
| 6,364,329 | B1 | 4/2002 | Holub et al. | |
| 6,550,860 | B2 | 4/2003 | Lombardi | |
| 7,347,430 | B2 | 3/2008 | Jenkins | |
| 7,708,290 | B2 | 5/2010 | Jenkins | |
| 7,891,677 | B2 | 2/2011 | Jenkins | |
| 8,196,938 | B2 * | 6/2012 | Jenkins | 280/47.26 |
| 2011/0115175 | A1 | 5/2011 | Jenkins | |

* cited by examiner

MODULAR MOBILE WORKSTATION WITH STORAGE CAPACITY

CROSS-REFERENCES TO RELATED APPLICATIONS

This application is a continuation of application Ser. No. 12/929,443 filed Jan. 25, 2011 now U.S. Pat. No. 8,196,938, which is a continuation of application Ser. No. 12/659,598 filed Mar. 15, 2010 now U.S. Pat. No. 7,891,677, which is a continuation of application Ser. No. 12/071,444 filed Feb. 21, 2008 now U.S. Pat. No. 7,708,290, which is a continuation of application Ser. No. 11/002,434 filed Dec. 3, 2004 now U.S. Pat. No. 7,347,430, which claims the benefit of Provisional Application No. 60/529,095 filed Dec. 15, 2003, the entire contents of each of which are hereby incorporated by reference in this application.

FIELD OF THE INVENTION

The illustrative embodiments relate to modular furniture, mobile workstations and portable storage. More particularly, the illustrative embodiments relate to a modular mobile workstation with storage capacity. Specifically, the illustrative embodiments relate to a modular mobile workstation, in which a traveler can store items, and which a traveler can easily transport and assemble into various configurations, including, but not limited to, a stool, a table, and a coat hanger. Such an apparatus will be useful to nomadic high tech workers or other travelers who need a mobile workspace.

BACKGROUND AND SUMMARY OF THE INVENTION

Current luggage is functional as mobile storage, but is typically designed in a manner that renders it virtually useless as a workspace or furniture, due in some part to the material comprising the luggage, the shape and size of the luggage, and the rigidity of the luggage frame. Other easily transportable containers not traditionally thought of as luggage suffer from similar shortcomings, and containers suitable for serving as a workspace or furniture are usually not easily transported from site to site. A person who frequently travels, such as a nomadic high tech worker, will commonly need to carry several different items for the purposes of luggage and workspace, or will possibly even forego a portable workspace altogether. Additionally, overcrowded airport gates and cab stands provide limited seating for a weary traveler. Needs exist for a container which can carry necessary items, be easily transported, and is modular to allow assembly into a variety of useful configurations.

The illustrative embodiments provide an easily transportable modular mobile workstation with storage capacity. The illustrative embodiments consist of a modular outer shell, wheels, a means for securing the outer shell components to each other, an inner shell, and a handle.

The outer shell consists of two interlocking components with a sidewall or sidewalls, an open end and a closed end. In a preferred embodiment, the components are comprised of 3003H14 hardened 16 gauge spun aluminum, although any suitable load bearing, rigid material may be used. Turnbuckles can be affixed to the exterior of the components to allow positioning and affixation of certain means for securing the outer shell components to each other. The outer shell can also be covered by a durable, and/or decorative material to provide a frictional grip for certain securing means and to add to the aesthetic value of the apparatus. In a preferred embodiment, DesignTex recyclable felt from the Climatex and Lifecycle processes is used, although any suitable material may be used.

The interlocking rim of the sidewall or walls of the components has both raised and lowered portions that add to the structural integrity of the outer shell. The raised portions of one component fit into the lowered portions of the opposing component, locking the components in place and forming the outer shell. The raised portions may include a protruding lip to add stability to the components when used as modular furniture, such as independently as stools or a stool and table, or in combination as a high table.

The wheels are attached to the interlocking outer shell components and allow the apparatus to be pulled or pushed by the user. In a preferred embodiment, two large wheels are affixed to the closed ends of the outer shell components by an axel, although any suitable wheel configuration that would allow the apparatus to roll may be affixed by any suitable means.

In a preferred embodiment, the wheels have an outer covering which is shore A 50 natural rubber elastomer. Underneath the covering is a rigid platter, comprised of 3003H14 hardened 12 gauge spun aluminum in a preferred embodiment. The platter is attached to a composite disc, and in a preferred embodiment, the disc is a Baltek HPC composite panel 1208 with a rigid end grain oriented balsa core, weighing approximately 0.93 pounds per square foot. Below the disc is a second rigid platter, made of the same material as the first rigid platter in a preferred embodiment. The second platter has a channel machined into its surface, in which bearings for the wheel can rest. A similar channel, opposite the platter channel, is machined into the closed end of the interlocking component to which the wheel is affixed. Ball bearings are inserted between the two channels, allowing the wheel to smoothly roll. In a preferred embodiment, ¼" delrin ball bearings are used. Although the wheel has been described in terms of the preferred embodiments, and suitable replacement materials may be used. Additionally, any other suitable construction of a wheel may be used.

In a preferred embodiment, the interlocking components are secured in place by a securing scarf. The securing scarf attaches to turnbuckles and wraps around the outer shell of the apparatus, holding the components in place. In a preferred embodiment, the scarf is die cut from AllFelt F-7/F-55. A series of holes are die cut into the scarf. Button holes are cut and finished with a grommet comprised of aluminum or some other suitable material. The button holes are positioned over the turnbuckles to align and affix the scarf. As the scarf is wrapped, the handle can be affixed thereby in a variety of configurations. If the handle is collapsed and rested against the side of the outer shell, the scarf holds the handle in place as a carrying handle, and a circular hole in the scarf allows the user to grip the shaft of the handle and carry the apparatus. If the handle is extended and one end is against the side of the outer shell, an oblong hole in the scarf holds the handle in place as a pulling or pushing handle. A similar oblong hole holds the handle in place as a coat rack when the apparatus is rested on one end. Felt pads may be sewn into the scarf for a decorative effect, and aligned so that they show through the holes in the scarf when the scarf is secured about the apparatus. The pads also may be softer than the scarf material, reducing wear and tear on the hands of the user when gripping the handle through the large hole in order to carry the apparatus. In a preferred embodiment, the pads are cut from AllFelt F-2. A pocket or pockets may be sewn into the scarf to provide the user with a better grip when securing the scarf and to provide readily accessible carrying capacity for small items. In a preferred embodiment, hook and loop strips are also used to secure the scarf to itself. Although the scarf has been described in terms of a preferred embodiment, other suitable materials and configurations of holes may be employed. Additionally, other suitable methods of securing the components to each other and securing the handle to the shell may be used.

The inner shell provides the user with storage capacity and also provides stability to certain modular configurations such as the high table. The inner shell is designed to fit within the interlocking components comprising the outer shell, and in a preferred embodiment it is made from 3003H14 hardened 16 gauge spun aluminum, although any suitable material can be used. The inner shell may be removable from the component in which it rests, and may have handles cut within or attached to its sidewall or walls to aid the user in extracting it. The inner shell may also be lined with an interior sock. In a preferred embodiment, the interior sock is made from DesignTex recyclable felt from the Climatex and Lifecycle processes, but any suitable material may be used. Additionally, the inner shell may be compartmentalized to allow the user to easily store and sort materials of specific configurations. Compartmentalization also provides added protection for vulnerable objects, such as a laptop computer.

The handle serves a number of purposes depending on the configuration. In a preferred embodiment, the handle consists of a shaft, formed from two pieces of tubing, one fitting within the other, and two end pieces of tubing set perpendicular to the shaft. In a preferred embodiment, the tubing for the receiving shaft piece and the end handles is comprised of 6061-T6 hardened aluminum tubing, having 1/16" wall thickness and 3/4" diameter. The inserting shaft piece is comprised of a similar material but has a 5/8" diameter. The end pieces of tubing are capped, and in a preferred embodiment the caps are comprised of shore A 50 natural rubber elastomer. The end pieces are also curved slightly to rest securely against the outer shell when the handle is attached as a carrying handle. The shaft tubing inserting piece fits within the receiving piece and can be extended or compacted to vary handle length. A spring loaded stop button holds the two shaft pieces at opposition in either an extended or contracted position. The shaft is also curved slightly to raise it from the outer shell when the handle is attached as a carrying handle, this provides clearance to allow the user to grasp the shaft. Although the shaft has been described in terms of a preferred embodiment, other suitable materials and shaft configuration can be used.

These and other features, aspects and advantages of the instant invention will be more clearly understood from the review of the following detailed description of the invention when read in conjunction with the appended drawings, in which:

DETAILED DESCRIPTION OF THE DRAWINGS

Figure 1B:
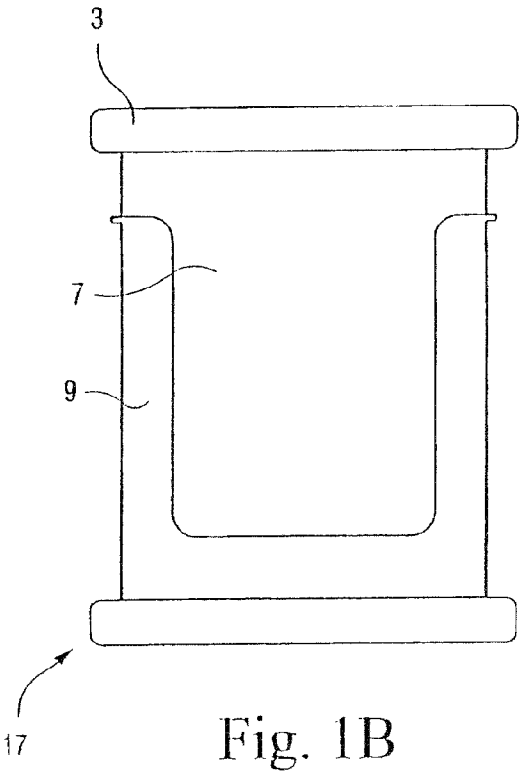
FIG. 1B shows a view of an elevation of the assembled modular mobile workstation without securing scarf and handle accessories.
Figure 1A:
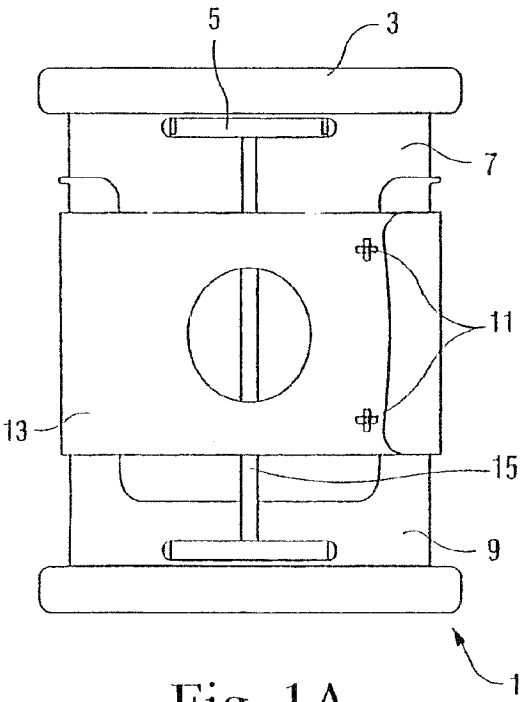
FIG. 1A shows a view of an elevation of the fully assembled modular mobile workstation.

FIG. 1A shows a view of an elevation of the fully assembled modular mobile workstation 1. The outer components 7, 9 interlock to form the outer shell of the modular mobile workstation 1. A wheel assembly 3 is affixed to the end of both outer components 7, 9. The securing scarf 13 is wrapped around the outer shell comprised of the interlocking outer components 7, 9. The turnbuckles 11 attach the securing scarf 13 to the interlocked outer components. The securing scarf 13 presses against the shaft 15 of the collapsible handle 5 and holds the handle 5 in place against the interlocked outer components 7, 9

FIG. 1B shows a view of an elevation of the assembled modular mobile workstation 17 without securing scarf and handle accessories. One outer component 7 interlocks with the other outer component 9 to form the assembled modular mobile workstation 17. A wheel assembly 3 is affixed to the closed end of both outer components 7, 9.

Figure 2A:
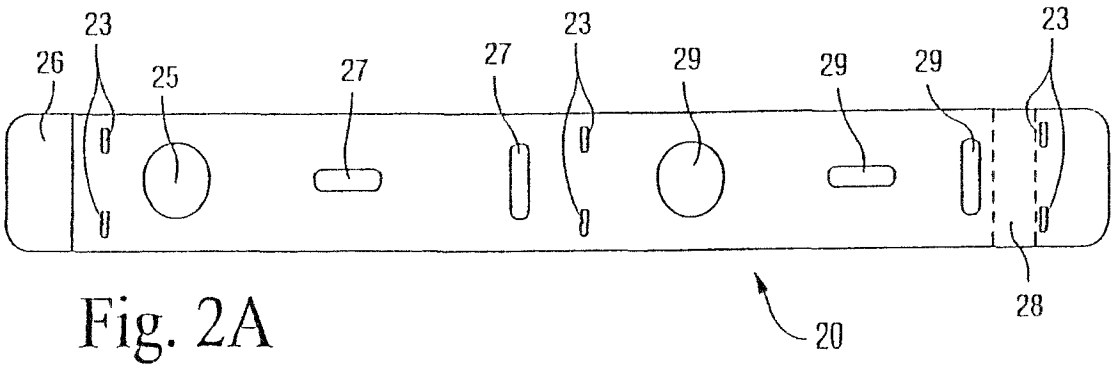
FIG. 2A shows a view of the front face of the securing scarf.
Figure 10:
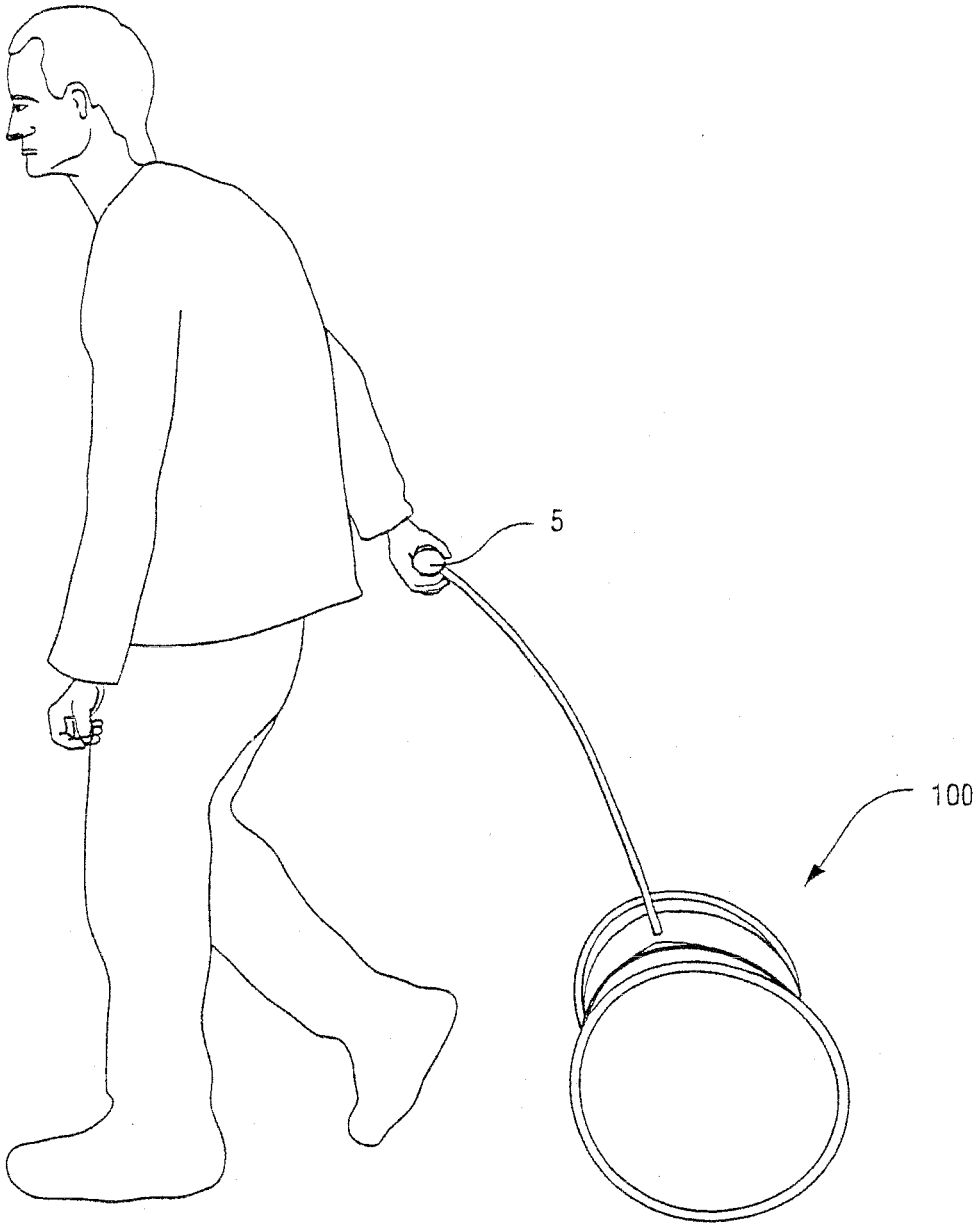
FIG. 10 shows a view of a person pulling the modular mobile workstation in its rollable form.
Figure 13:
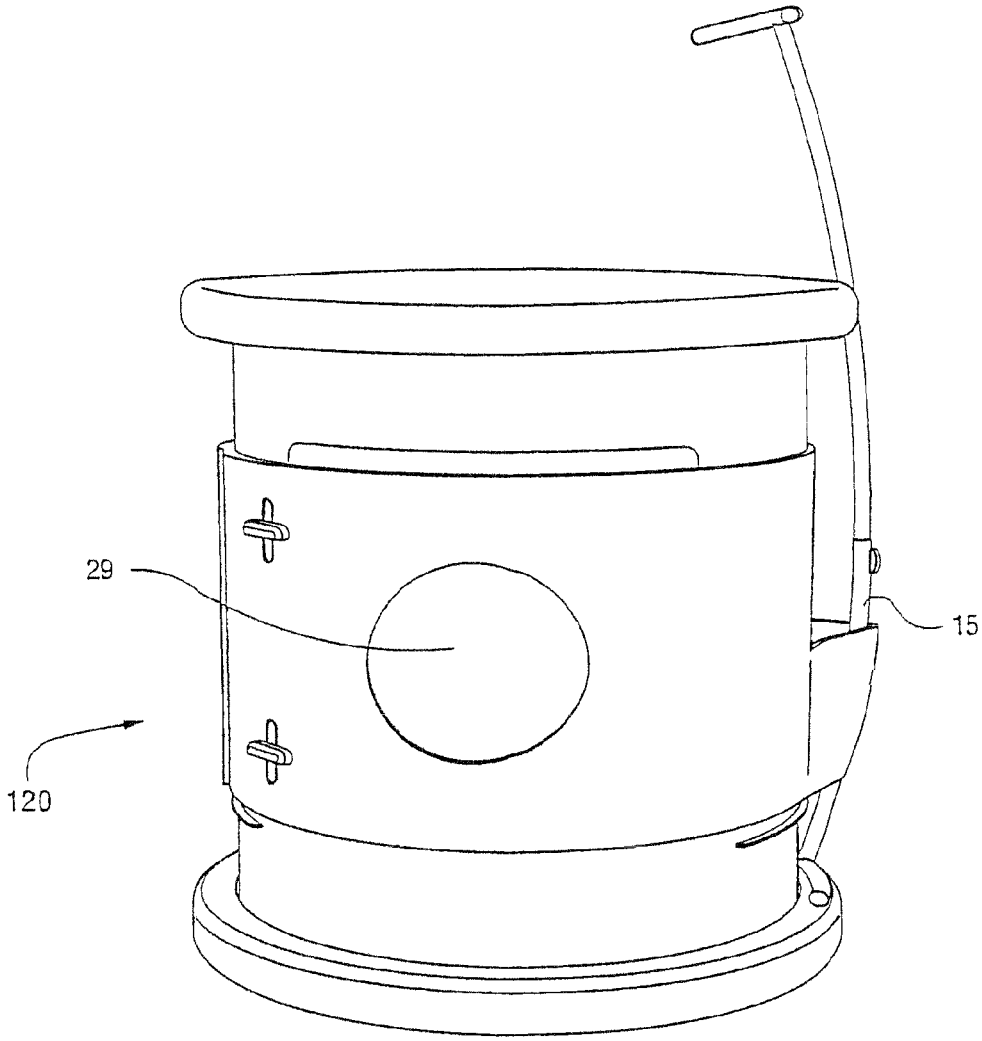
FIG. 13 shows a perspective view of the modular mobile workstation in a table and coat rack form.

FIG. 2A shows a view of the front face of the securing scarf 20. At one end of the scarf 20, a pocket 21 can be sewn to allow the user to easily grip the scarf. Fabricated holes 23 in the scarf are cut to fit around the turnbuckles on the outer components shown in FIG. 1A. Another fabricated hole 25 is cut in the scarf 20 to allow access to the handle shaft when the fully assembled modular mobile workstation shown in FIG. 1A is carried. Fabricated holes 27 allow the user to attach the handle to the fully assembled modular mobile workstation for use as a coat rack, as shown in FIG. 13, or to pull the modular mobile workstation, as shown in FIG. 10. Pads 29 are sewn to the securing scarf 20 in a position such that they underlie the fabricated holes 25, 27 when the scarf is wrapped around the fully assembled modular mobile workstation shown in FIG. 1A. A portion 28 of the securing scarf can contain one side of a hook and loop securing strip.

Figure 2B:
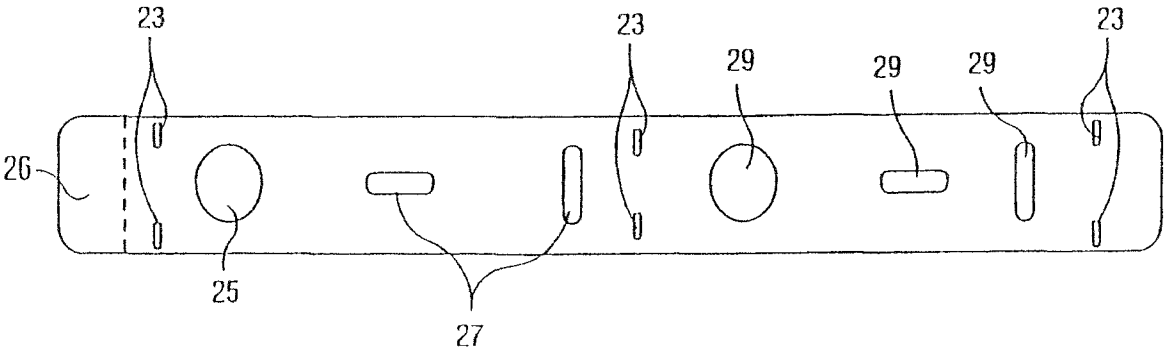
FIG. 2B shows a view of the rear face of the securing scarf.

FIG. 2B shows a view of the rear face of the securing scarf. A portion 26 of the securing scarf can contain the other side of a hook and loop securing strip. The fabricated holes 23 fit around the turn buckles. A fabricated hole 25 allows access to the shaft of the handle when it is secured to the fully assembled modular mobile workstation. Additional fabricated holes allow affixation of the handle to the modular mobile workstation for various purposes. Felt pads 29 are placed on the securing scarf such that they underlie the fabricated holes 25, 27 when the scarf is in place around the fully assembled modular mobile workstation.

Figure 3A:
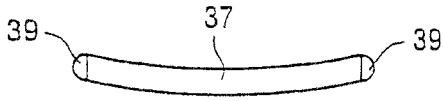
FIG. 3A shows a top view of one end of the handle.

FIG. 3A shows a top view of one end of the handle. A bar 37 perpendicularly caps the shaft and plugs 39 may be inserted in the ends of the bar 37.

Figure 3B:
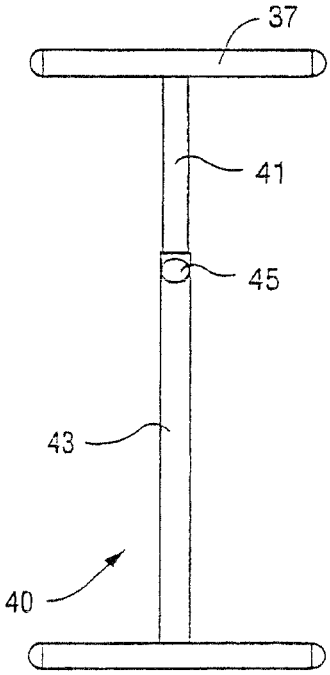
FIG. 3B shows a front view of an elevation of the handle in a collapsed form.

FIG. 3B shows a front view of an elevation of the handle in a collapsed form. The handle 40 can collapse when a button 45 is depressed or manipulated. An inner shaft piece 41 slides into an outer shaft piece 43 to reduce the length of the handle shaft. A bar 37 perpendicularly caps both outer ends of the shaft pieces 41, 43.

Figure 3C:
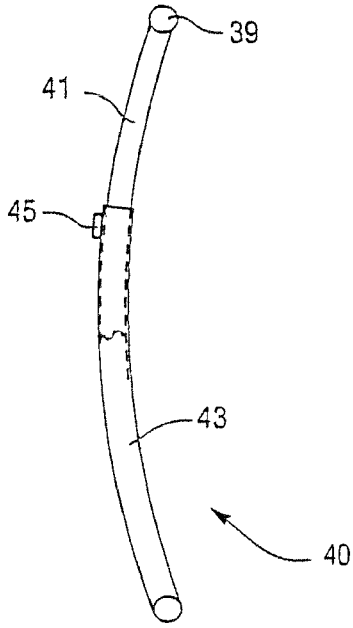
FIG. 3C shows a side view of an elevation of the handle in a collapsed form.

FIG. 3C shows a side view of an elevation of the handle in a collapsed form. The handle 40 has a collapsible shaft consisting of two shaft pieces 41, 43. A button 45 unlocks the shaft so that it may be collapsed or extended. Bars are attached perpendicular to the outer ends of the shaft pieces 41, 43 and the bars may have plugs 39 inserted in their ends.

Figure 4A:
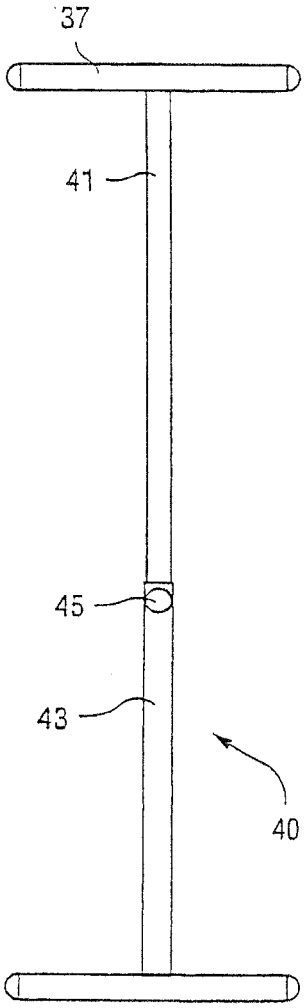
FIG. 4A shows a front view of an elevation of the handle in an extended form.

FIG. 4A shows a front view of an elevation of the handle in an extended form. The handle 40 is extended and an inner shaft piece 41 slides out of an outer shaft piece 43. A button 45 locks the shaft in its extended position. Bars 37 perpendicularly cap the outer ends of the shaft pieces 41, 43.

Figure 4B:
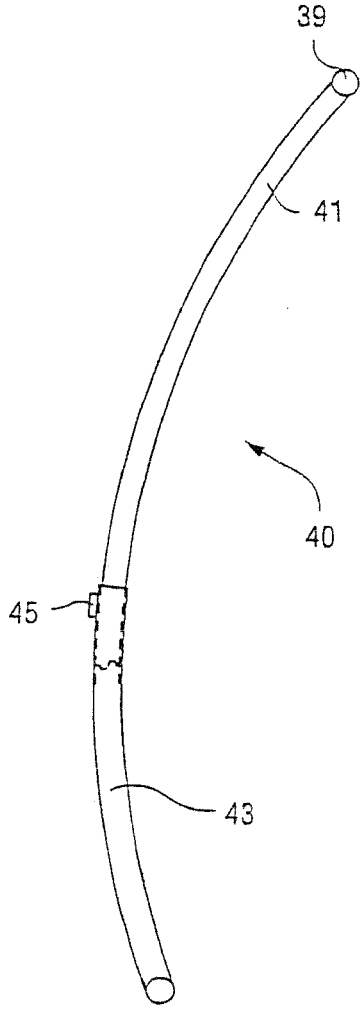
FIG. 4B shows a side view of an elevation of the handle in an extended form.
Figure 5:
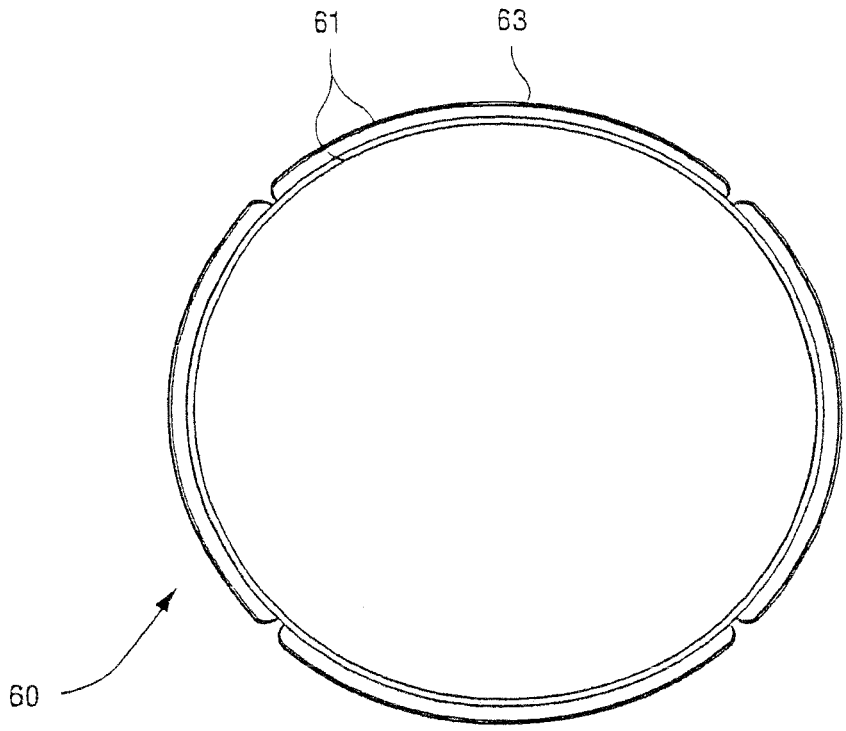
FIG. 5 shows a top view of the interlocked outer components.

FIG. 4B shows a side view of an elevation of the handle in an extended form. The handle 40 has a collapsible shaft consisting of two shaft pieces 41, 43. A button 45 locks the shaft pieces in place once the shaft is extended. Bars are attached perpendicular to the outer ends of the shaft pieces 41, 43 and the bars can have plugs 39 inserted in their ends. FIG. 5 shows a top view of the interlocked outer components 60. The component 61 is covered by a durable covering 63.

Figure 6:
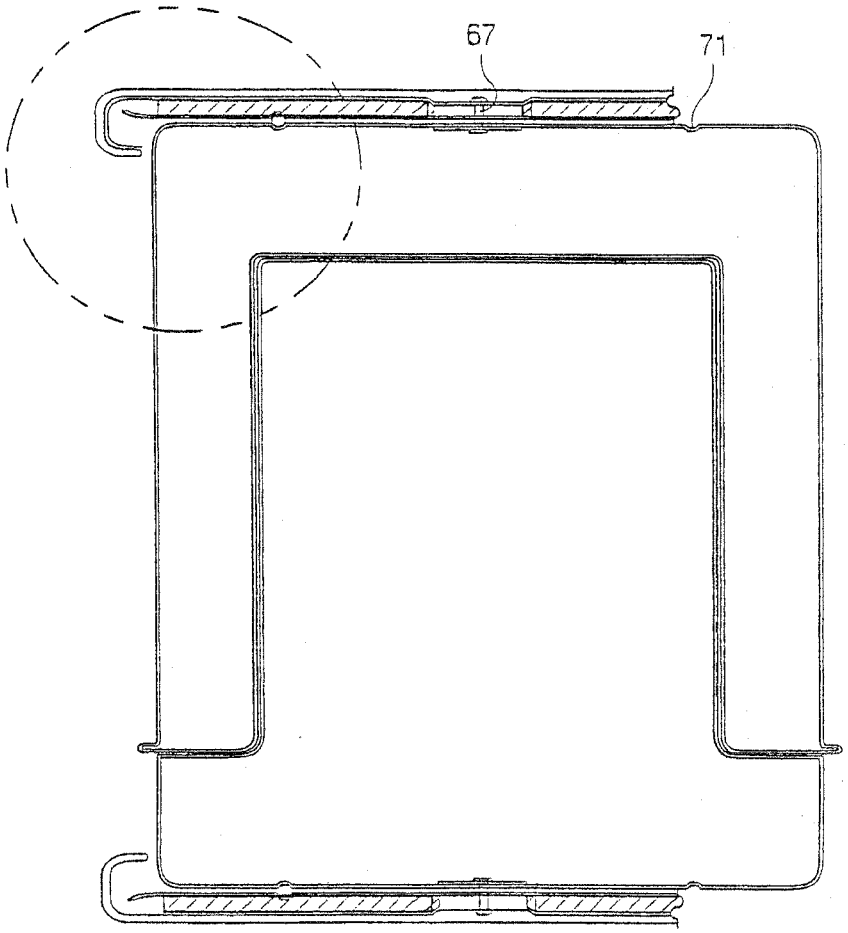
FIG. 6 shows a view of a cross-section of an elevation of the interlocked outer components with wheels attached.

FIG. 6 shows a view of a cross-section of an elevation of the interlocked outer components with wheels attached. An axle 67 attaches the wheel to the closed end of an interlocking outer component and the closed component also has a groove 71, in which a ball-bearing can rest, machined into the outer end.

Figure 7:
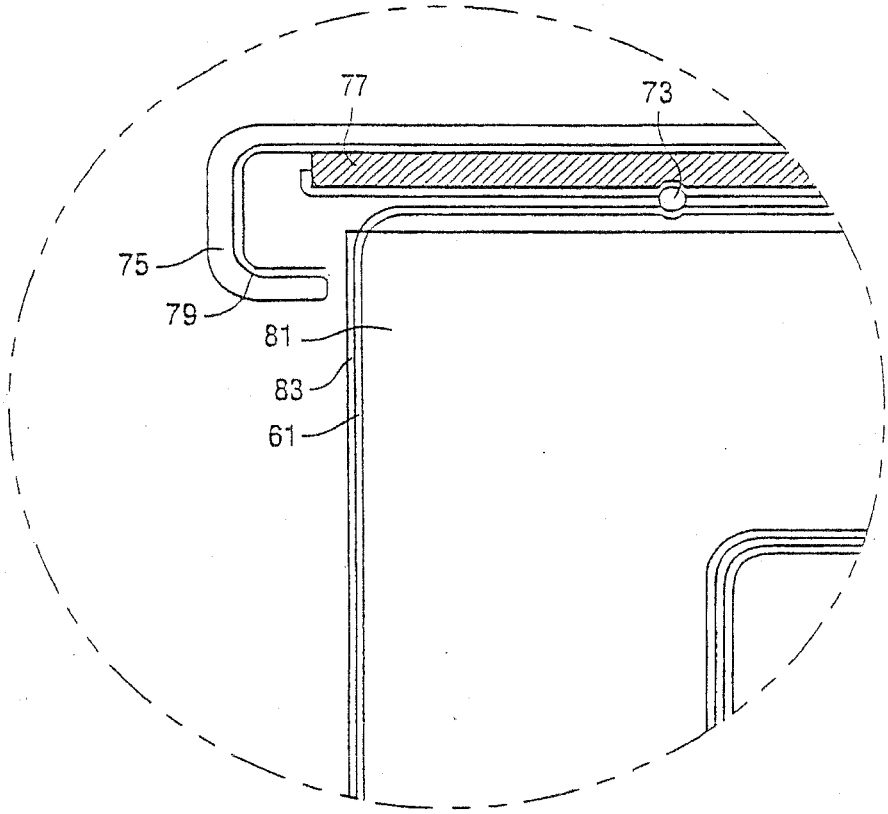
FIG. 7 shows a closer view of the circled portion of FIG. 6, showing a detailed cross section of the wheel assembly and interlocking outer component assembly.

FIG. 7 shows a closer view of the circled portion of FIG. 6, showing a detailed cross section of the wheel assembly and interlocking outer component assembly. The outer wheel 75 fits around an outer platter 79. The platter rests against a composite disc 77 backed by an inner platter 81. The interlocking outer component consists of a shell 61 encased in a durable covering 83. Ball bearings 73 fit between grooves in the inner platter 81 and the outer component shell 61.

Figure 8B:
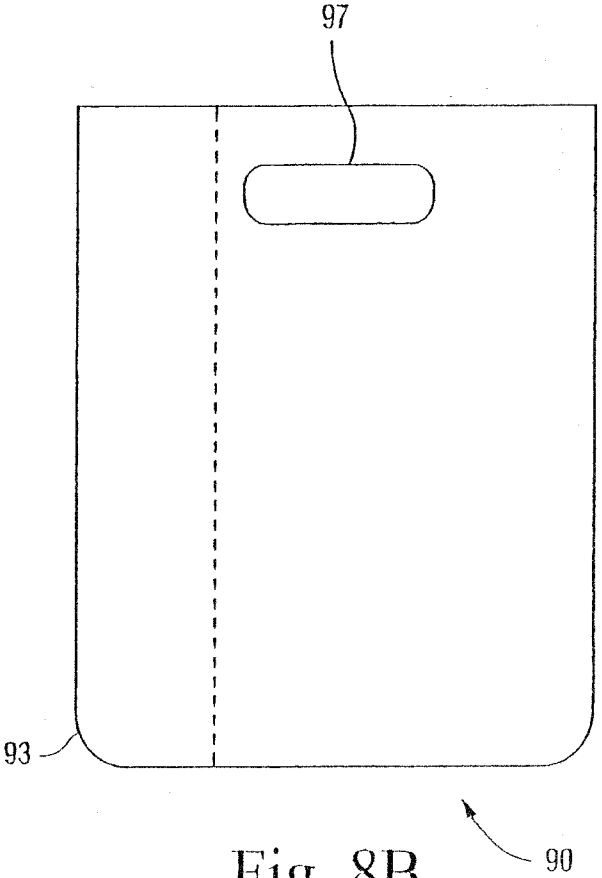
FIG. 8B shows a view of an elevation of the center storage component.
Figure 8A:
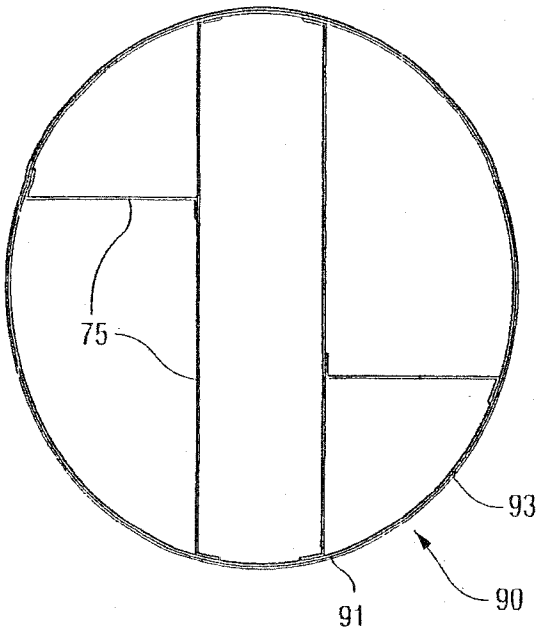
FIG. 8A shows a top view of the center storage component containing optional partitions.

FIG. 8A shows a top view of the center storage component containing optional partitions. The outer shell 93 of the center storage component 90 is exposed and the inside of the center storage component 90 is covered by a durable material 91. Partitions 95 can be added to the center storage component to section off the interior.

FIG. 8B shows a view of an elevation of the center storage component. The outer shell 93 of the storage component 90 has handle holes 97 cut into it.

Figure 9:
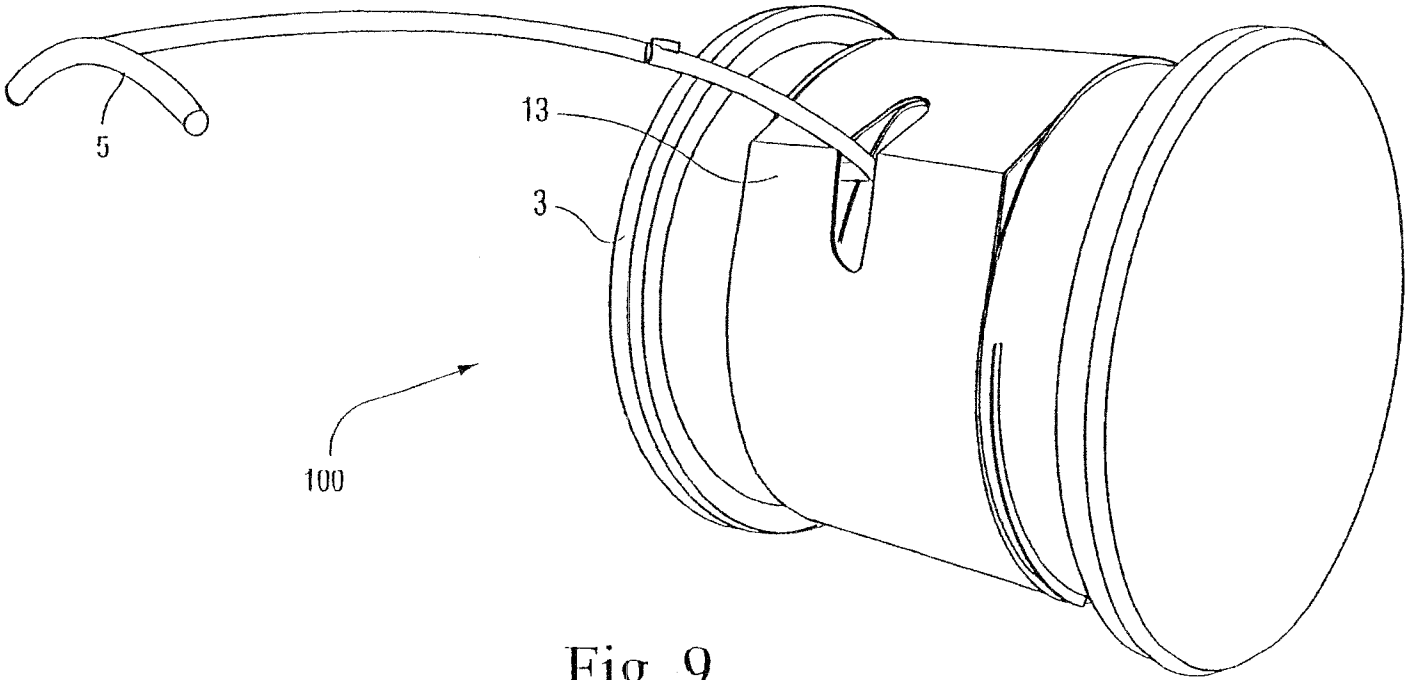
FIG. 9 shows a perspective view of the modular mobile workstation assembled in a rollable form.

FIG. 9 shows a perspective view of the modular mobile workstation assembled in a rollable form 100. The handle 5 extends out from the modular mobile workstation and is attached by securing scarf 13. The wheels 3 roll freely and the modular mobile workstation assembled in a rollable form 100 can be moved about.

FIG. 10 shows a view of a person pulling the modular mobile workstation in its rollable form 100. The person grasps the handle 5 and pulls the modular mobile workstation in its rollable form 100.

Figure 11:
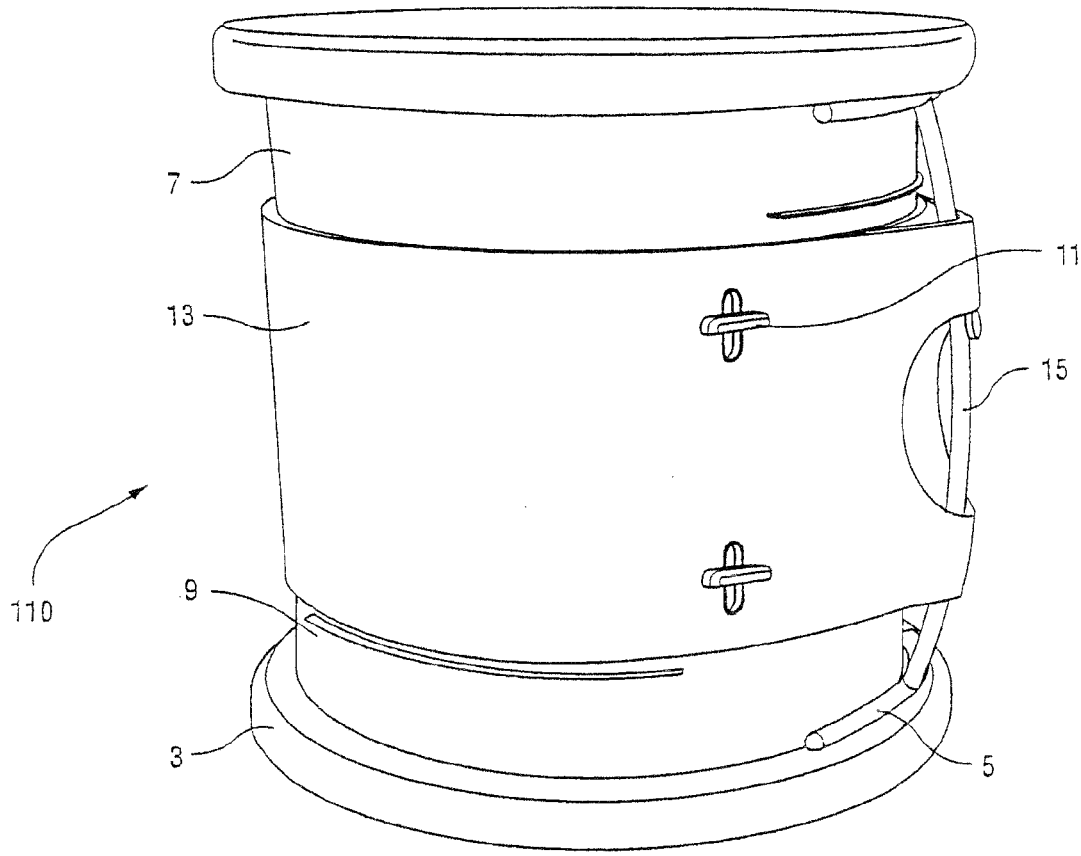
FIG. 11 shows a perspective view of the modular mobile workstation assembled in a carriable form.

FIG. 11 shows a perspective view of the modular mobile workstation assembled in a carriable form 110. The turnbuckles 11 hold the securing scarf 13 in place around the interlocking outer components 7, 9. The handle 5 is held securely against the interlocking outer components 7, 9. The modular mobile workstation stands on the face of a wheel 3. The shaft 15 of the handle 5 is exposed through a hole in the securing scarf 13 to allow easy access to the shaft 15.

Figure 12:
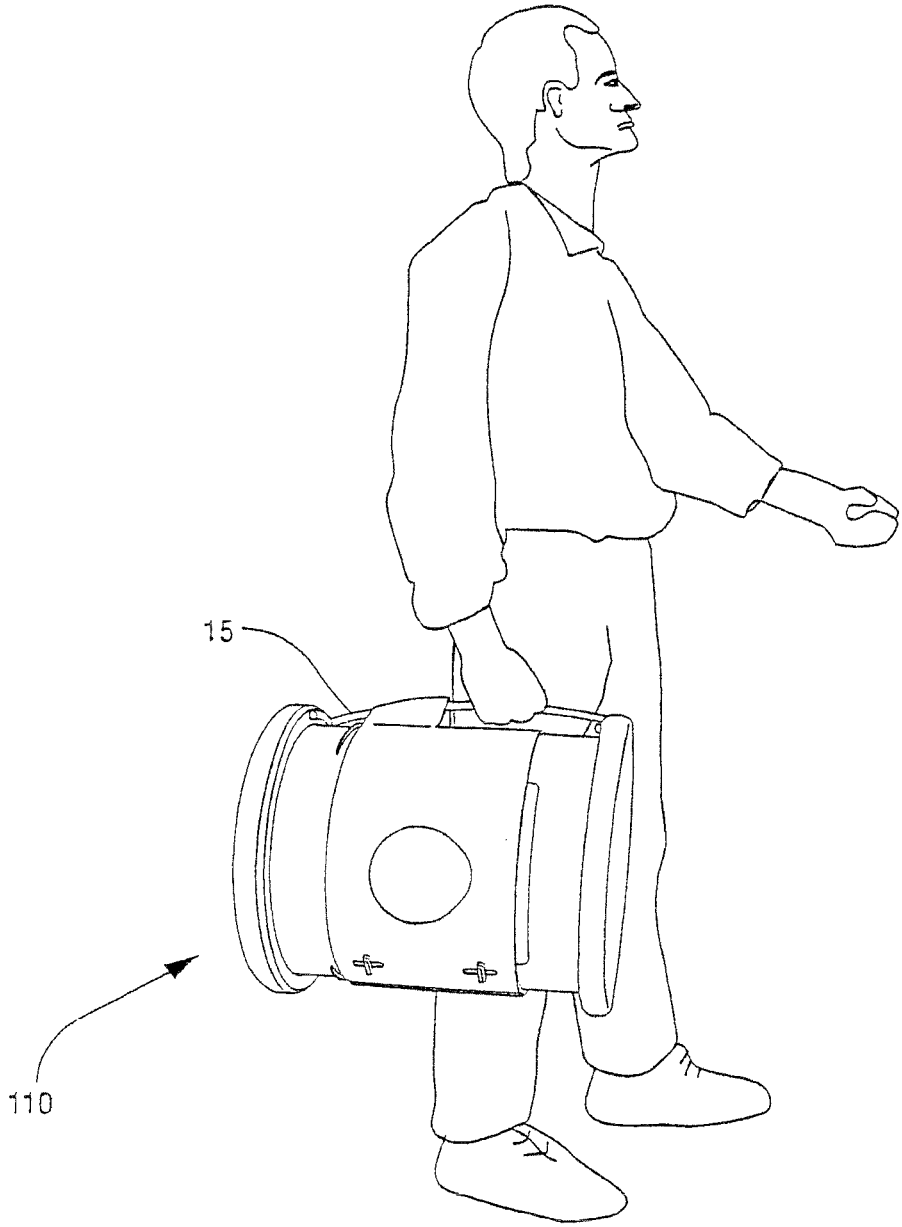
FIG. 12 shows a view of a person carrying the modular mobile workstation in its carriable form.

FIG. 12 shows a view of a person carrying the modular mobile workstation in its carriable form 110. The person grips the shaft 15 and is able to thereby carry the modular mobile workstation in its carriable form 110.

FIG. 13 shows a perspective view of the modular mobile workstation in a table and coat rack form 120. The shaft 15 has been extended and one end of the handle forms a coat rack. The upper wheel face can be used as a table top, and a fabric patch 29 shows through the hole in the securing scarf.

Figure 14:
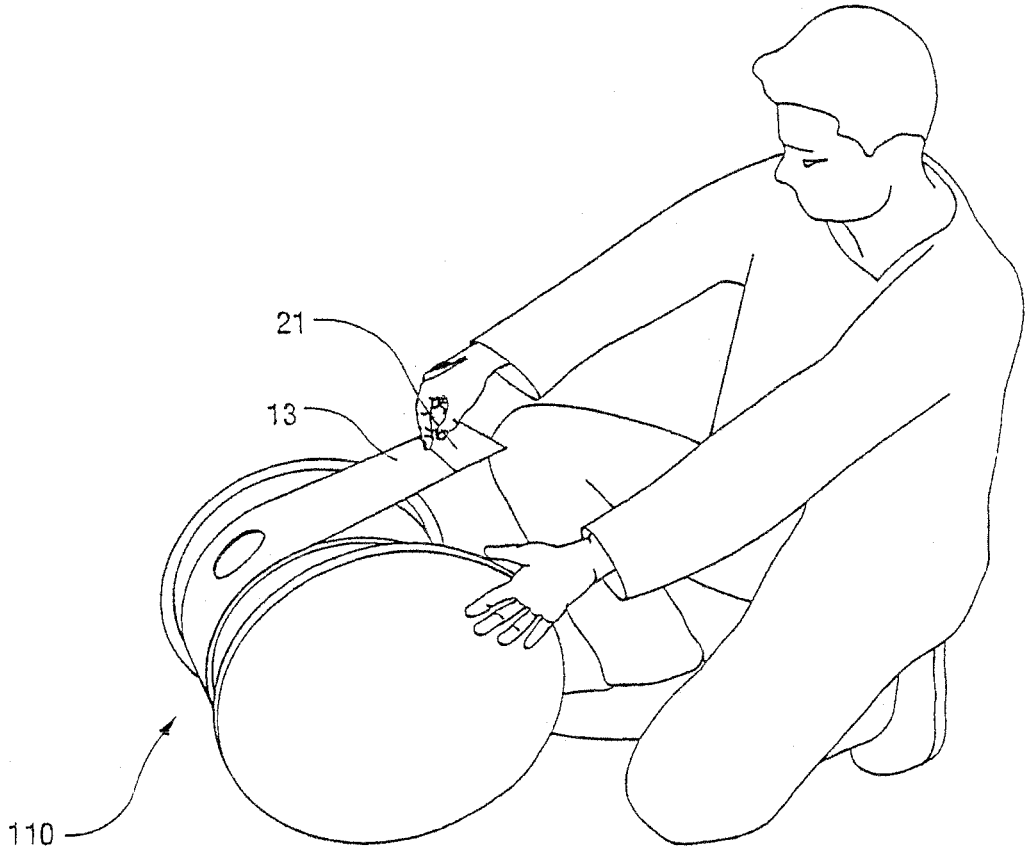
FIG. 14 shows a view of a person unwrapping the securing scarf.

FIG. 14 shows a view of a person unwrapping the securing scarf. The person grips the scarf 13 by the pouch 21 and unwraps it from the modular mobile workstation 110.

Figure 15:
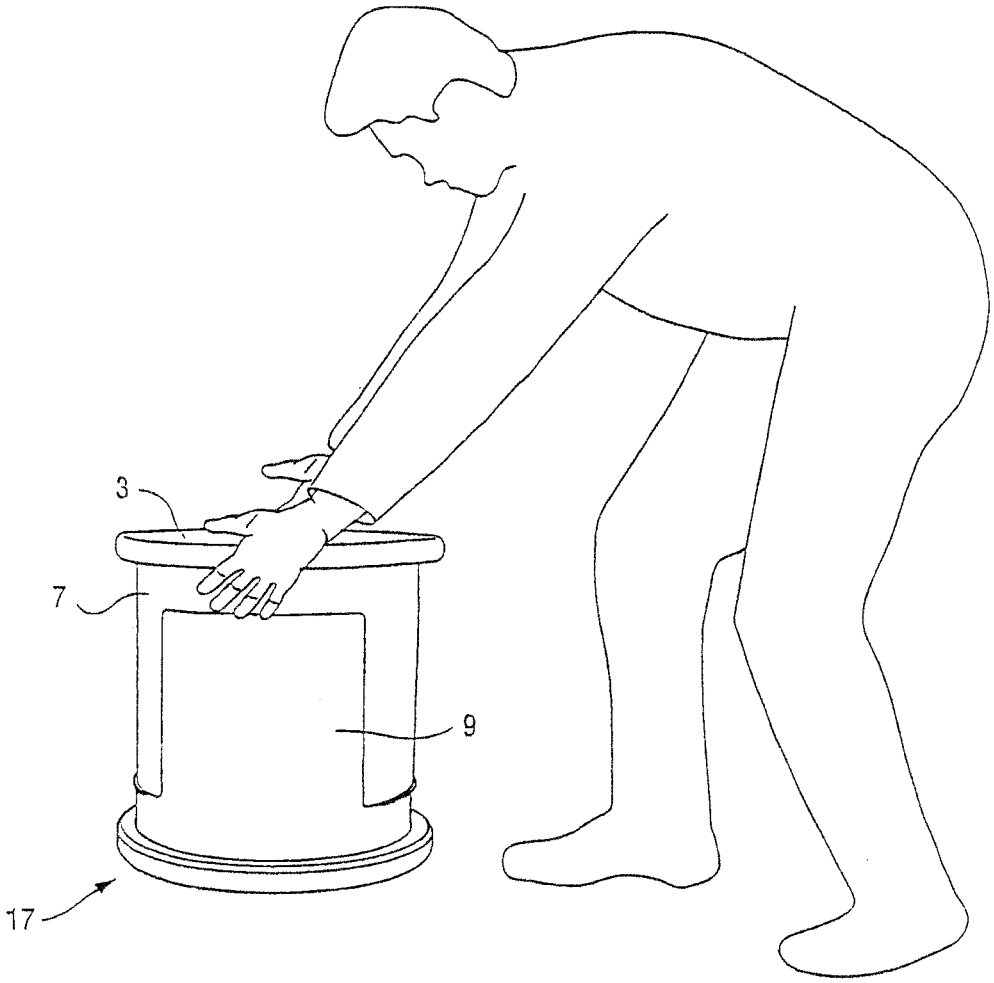
FIG. 15 shows a view of a person lifting up on one wheel of the modular mobile workstation.

FIG. 15 shows a view of a person lifting up on one wheel of the modular mobile workstation 17 without a securing scarf wrapped about it. The person grasps the wheel 3 attached to one interlocking outer component 7 and lifts up to disengage one interlocking outer component 7 from the other interlocking outer component 9.

Figure 16:
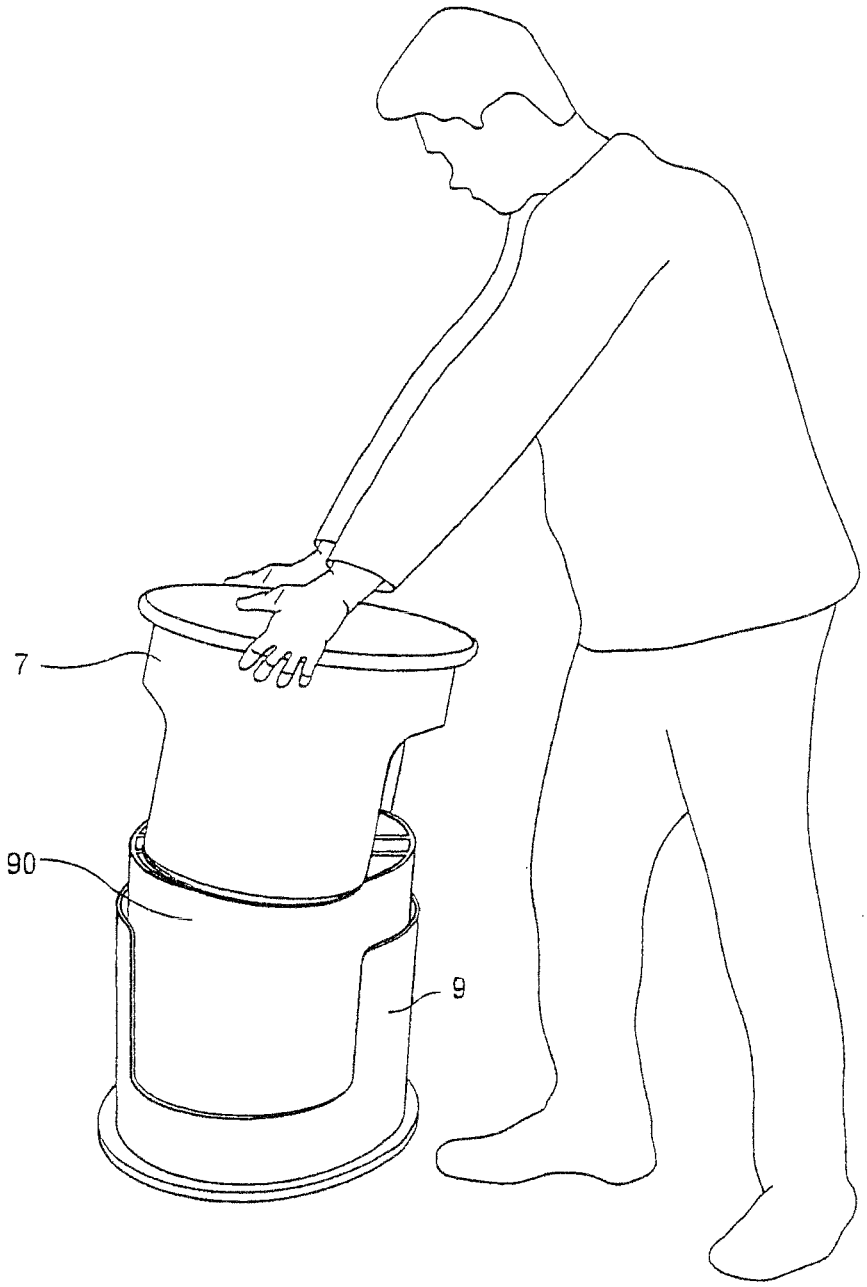
FIG. 16 shows a view of a person lifting up one of the interlocking outer components to expose the removable inner component.

FIG. 16 shows a view of a person lifting up one of the interlocking outer components to expose the removable inner component. One interlocking outer component 7 is lifted away to expose the removable inner component 90 resting in the other interlocking outer component 9.

Figure 17:
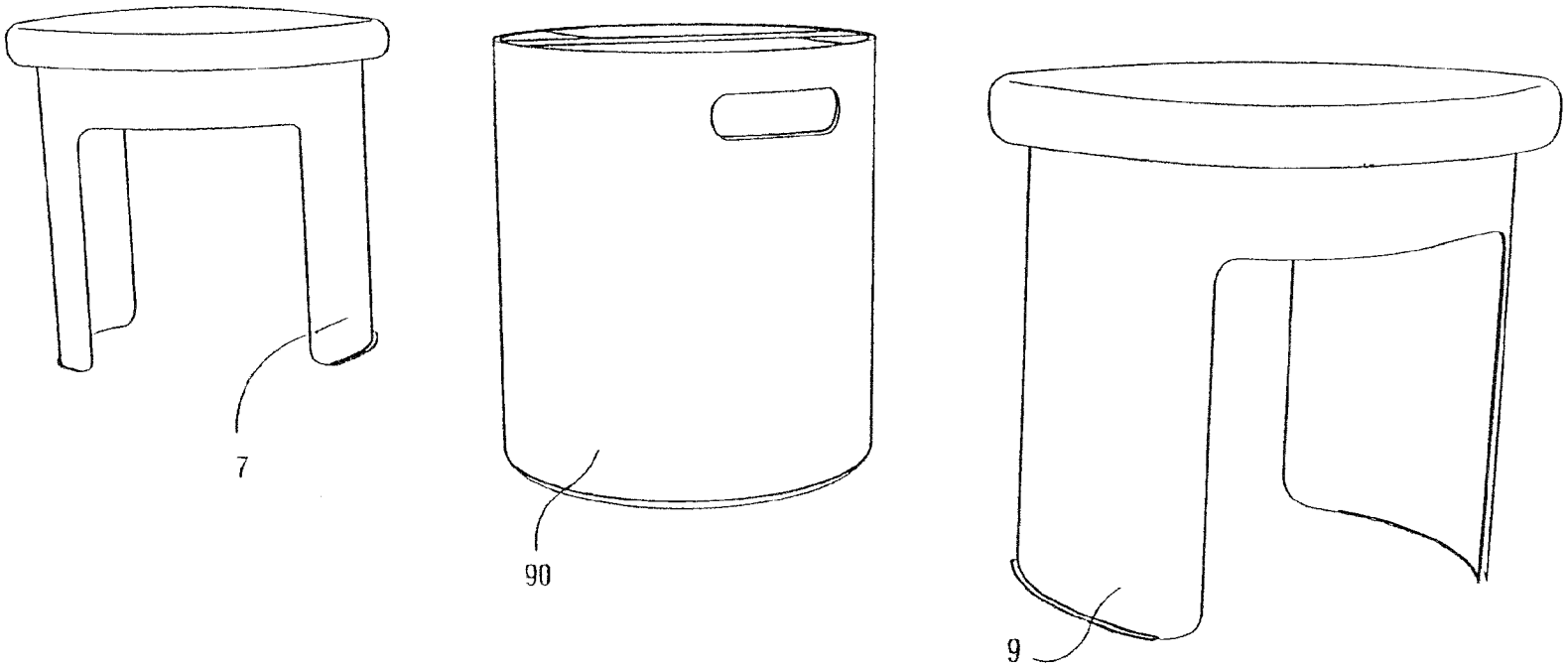
FIG. 17 shows a perspective view of the interlocking outer components and the removable inner component sitting as separate pieces.

FIG. 17 shows a perspective view of the interlocking outer components and the removable inner component sitting as separate pieces. The removable inner component 90 can be separated from the interlocking outer components 7, 9 and all three modular pieces can be used as furniture.

Figure 18:
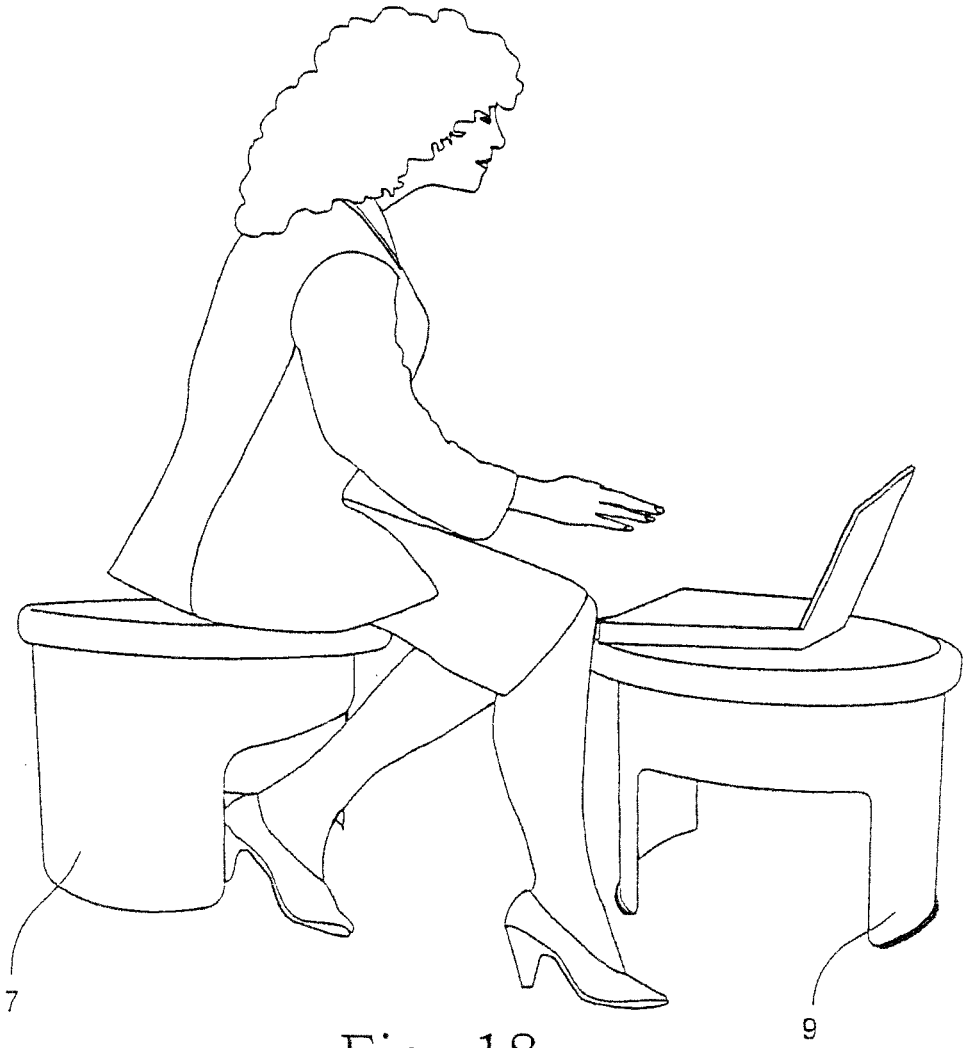
FIG. 18 shows a view of person using the interlocking outer components as a stool and low table combination.

FIG. 18 shows a view of person using the interlocking outer components as a stool and low table combination. The person is sitting on an interlocking outer component 7 and is using the other interlocking outer component 9 as a table.

Figure 19:
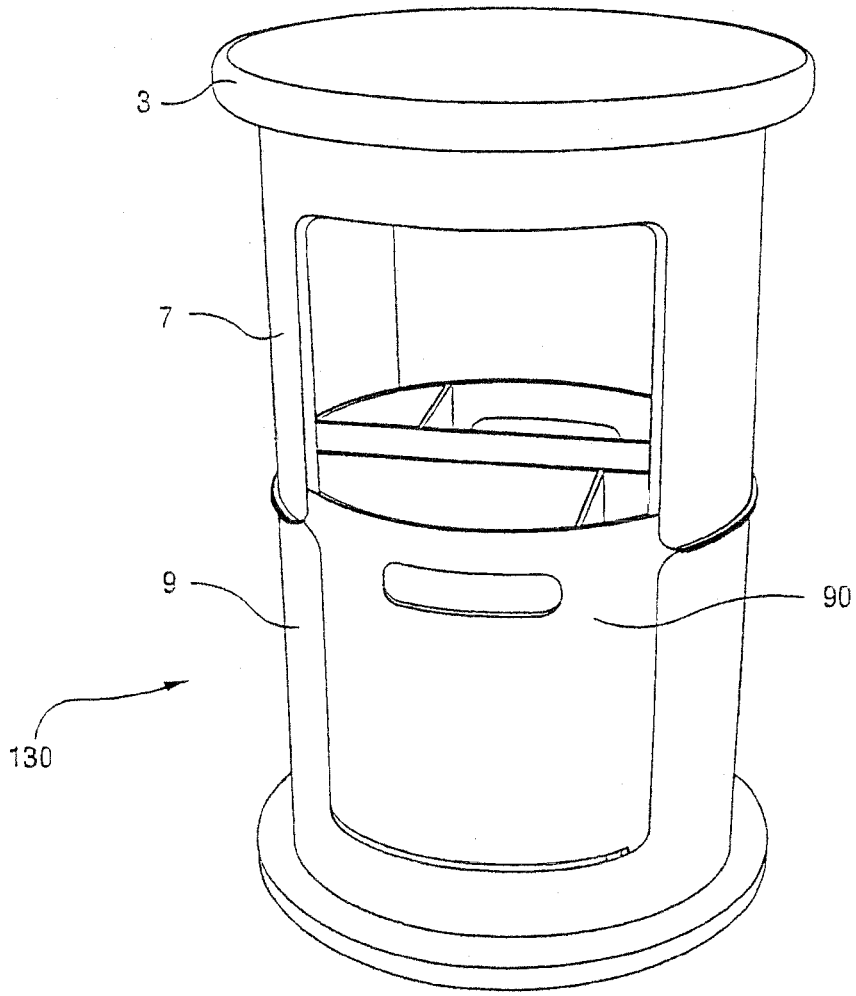
FIG. 19 shows a perspective view of one interlocking outer component resting on top of the other interlocking outer component and gripping the inner component to form a high table.

FIG. 19 shows a perspective view of one interlocking outer component resting on top of the other interlocking outer component and gripping the inner component to form a high table. One interlocking outer component 7 rests on the end of the other interlocking outer component 9 and grips the removable inner component 90 which prevents the upper outer component 7 from slipping sideways. This assembly 130 can be used as a high table with the face of the wheel 3 of the upper interlocking outer component 7 forming the tabletop.

Figure 20:
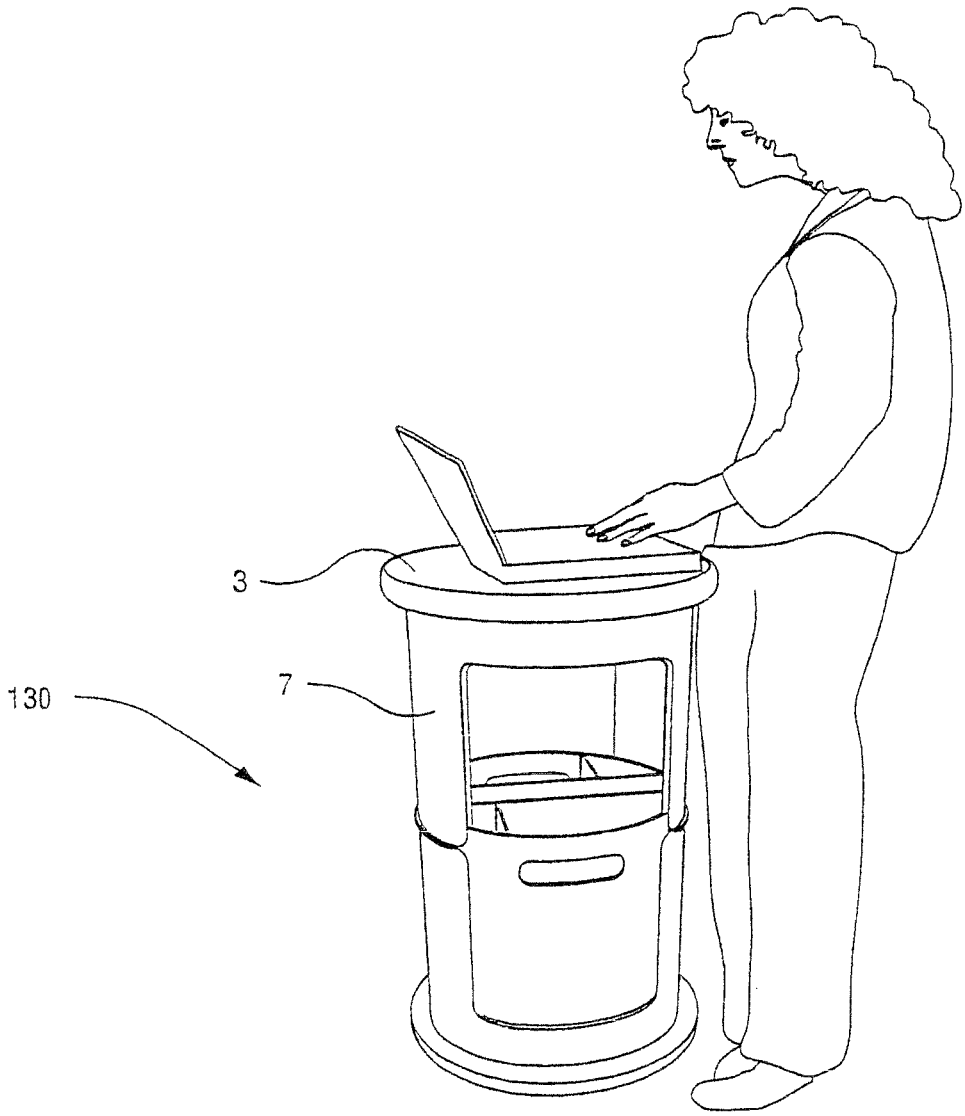
FIG. 20 shows a view of a person using the high table of FIG. 19.

FIG. 20 shows a view of a person using the high table of FIG. 19. The person stands next to the assembly 130 and rests a laptop on the face of the wheel 3 of the upper interlocking outer component 7.

While the preferred forms and embodiments of the instant invention have been illustrated and described herein, various changes and modifications can be made within the scope of the invention. In other words, the invention is not limited to the specific embodiments described herein. For example, the invention is not limited to the specific sizes of the various parts indicated in the drawings. Instead, the sizes indicated herein simply reflect a preferred embodiment. The same is true with respect to the specific component shapes and materials described herein.

What is claimed is:

1. A method of using an apparatus that is selectively configurable in plural arrangements, the apparatus comprising:

two interlockable hard-shelled outer components, each said outer component having an open end and a closed end;

at least one wheel provided to the closed end of each said outer component; and a hard-shelled inner component; and wherein in a first arrangement, a securing mechanism of the apparatus is operable to secure the outer components to one another in an interlocked position, the hard shelled inner component provides a storage area, and the apparatus is rollable on the wheels provided to the closed end of each said outer component, and wherein in a second arrangement, the first and second outer components are orientable such that the at least one wheel provided to the closed end of each said outer component is substantially parallel to the ground, the first outer component is shaped and arranged to serve as a top of a low table, the second outer component is shaped and arranged to serve as a seat, and the second outer component has a rigidity suitable for supporting the weight of a person;

the method comprising: manipulating the apparatus to change from one of said arrangements to another of said arrangements.

2. The method of claim 1, wherein the apparatus further comprises an axel attached to an outer surface of the closed end of each said outer component and connecting respective wheels and outer components.

3. The method of claim 1, wherein the first and second outer components are further shaped and arranged such that, in a third arrangement, the first and second outer components are stackable to form a high table, the at least one wheel provided to the closed end of each said outer component being substantially parallel to the ground at top and bottom end portions of the high table.

4. The method of claim 3, wherein the wheels of the low and high table are rotatable in the second and third arrangements, respectively.

5. The method of claim 1, wherein the apparatus further comprises a removable handle, and wherein the securing mechanism of the apparatus is further operable to secure the handle to at least one of the outer components.

6. The method of claim 5, wherein the handle comprises an extendable shaft and two end pieces affixed to the respective ends of the shaft.

7. The method of claim 6, wherein the extendable shaft comprises a plurality of lengths of shaft and a locking mechanism.

8. The method of claim 6, wherein the end pieces comprise a length of shaft and two end caps.

9. The method of claim 1, wherein at least one of the interlocking outer components has at least one turnbuckle affixed thereto.

10. The method of claim 1, wherein the inner component is removable from the outer component.

11. The method of claim 1, wherein the inner component further comprises a hollow shell having at least one divider therein.

12. A method of making an apparatus that is selectively configurable in plural arrangements, the method comprising:

providing two interlockable hard-shelled outer components, each said outer component having an open end and a closed end;

connecting at least one wheel provided to the closed end of each said outer component;

providing a hard-shelled inner component; and wherein in a first arrangement, a securing mechanism of the apparatus is operable to secure the outer components to one another in an interlocked position, the hard shelled inner component provides a storage area, and the apparatus is rollable on the wheels provided to the closed end of each said outer component, and wherein in a second arrangement, the first and second outer components being shaped and arranged to be orientable such that the at least one wheel provided to the closed end of each said outer component is substantially parallel to the ground in serving as a top of a low table or seat, the first and/or second outer components having rigidities suitable for supporting the weight of a person.

13. The method of claim 12, further comprising attaching an axel to an outer surface of the closed end of each said outer component and connecting respective wheels and outer components.

14. The method of claim 12, wherein in a third arrangement the first and second outer components are stackable to form a high table, the at least one wheel provided to the closed end of each said outer component being substantially parallel to the ground at top and bottom end portions of the high table.

15. The method of claim 14, wherein the wheels of the low and high table are rotatable in the second and third arrangements, respectively.

16. The method of claim 12, further comprising providing a handle to the apparatus.

17. The method of claim 16, further comprising providing a securing mechanism operable to secure the outer components in an interlocked position and operable to secure the first handle to at least one of the outer components.

18. The method of claim 17, wherein the securing mechanism comprises a strip of material for securing the interlocking outer components in an interlocked position and having at least one hole cut therein.

19. The method of claim 16, wherein the first handle comprises: an extendable shaft, and two end pieces affixed to the respective ends of the shaft.

20. The method of claim 12, wherein the inner component comprises a hollow shell having at least one open end.

* * * * *